US006814037B1

(12) United States Patent
Smith et al.

(10) Patent No.: US 6,814,037 B1
(45) Date of Patent: Nov. 9, 2004

(54) VARIABLE CAMSHAFT TIMING FOR INTERNAL COMBUSTION ENGINE WITH ACTUATOR LOCKING

(75) Inventors: Franklin R. Smith, Cortland, NY (US); Roger Simpson, Ithaca, NY (US); Marty Gardner, Ithaca, NY (US); Braman Wing, Interlaken, NY (US); Michael Duffield, Medina, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/602,993

(22) Filed: Jun. 24, 2003

(51) Int. Cl.[7] ..... F01L 1/34

(52) U.S. Cl. ..... 123/90.17; 123/90.15; 74/568 R

(58) Field of Search ..... 123/90.12, 90.15, 123/90.16, 90.17, 90.18; 74/568 R; 464/1, 2, 160

(56) References Cited

U.S. PATENT DOCUMENTS

| | | | | |
|---|---|---|---|---|
| 2,861,557 A | | 11/1958 | Stolte | 123/90 |
| 5,107,804 A | | 4/1992 | Becker et al. | 123/90.17 |
| 5,548,995 A | * | 8/1996 | Clinton et al. | 731/116 |
| 5,657,725 A | | 8/1997 | Butterfield et al. | 123/90.17 |
| 5,671,145 A | * | 9/1997 | Krebs et al. | 701/102 |
| 5,736,633 A | * | 4/1998 | Magner et al. | 73/116 |
| 6,250,265 B1 | | 6/2001 | Simpson | 123/90.17 |

* cited by examiner

*Primary Examiner*—Thomas Denion
*Assistant Examiner*—Jaime Corrigan
(74) *Attorney, Agent, or Firm*—Brown & Michaels, PC; Greg Dziegielewski

(57) ABSTRACT

A variable camshaft timing system having a camshaft with a vane-type rotor, where oscillation of the housing relative to the vane is actuated by pressurized engine oil, derived in part from a torque pulse in the camshaft. An annular locking plate is positioned coaxially with the camshaft and the housing. It is moveable relative to the housing along the longitudinal central axis of the camshaft between two positions, the teeth on the locking plate engaging the teeth on the housing and where the teeth on the locking plate are disengaged from the teeth on the housing, each position preventing circumferential movement of the housing relative to the rotor. The locking plate is biased by a plurality of metallic straps towards engagement of the teeth on locking plate with the teeth on the housing. The straps have one end secured to the locking plate and another end secured to the rotor.

4 Claims, 4 Drawing Sheets

VARIABLE CAMSHAFT TIMING FOR INTERNAL COMBUSTION ENGINE WITH ACTUATOR LOCKING

REFERENCE TO RELATED APPLICATIONS

This application is directed to improvements of the invention that is described and claimed in U.S. Pat. No. 6,250,265, which issued on Jun. 26, 2001, the disclosure of which is incorporated by reference herein.

BACKGROUND OF THE INVENTION

FIELD OF THE INVENTION

This invention relates to a variable valve timing system for an internal combustion engine. More particularly, this invention relates to a torque pulse actuated, hydraulic variable valve timing system of the foregoing type with locking capabilities to lock the components of the system in a fixed condition of operation during intervals of low hydraulic pressure, such as during engine start-up.

DESCRIPTION OF RELATED ART

U.S. Pat. No. 5,107,804 (Becker et al.), which is assigned to the assignee of this application, the disclosure of which is incorporated by reference herein, describes a vane-type, camshaft torque pulse actuated hydraulic camshaft or valve timing system for an internal combustion engine in which the hydraulic fluid that operates the camshaft phase shifting system is engine oil. Such a system has many operating advantages over other known types of valve or camshaft timing systems, for example, in the timeliness of response to changes in engine operating conditions. However, such systems tend to be noisy or otherwise unstable during periods of low engine oil pressure, which can often occur during engine start-up and can occasionally occur during other types of operating conditions. During these times, it is important to be able to lock the otherwise relatively movable components of the system into fixed positions relative to one another, and it is to the provision of an improved solution of the system locking requirements of such a variable valve timing system that the present invention is directed.

U.S. Pat. No. 2,861,557 (Stolte) also describes a hydraulic variable camshaft timing system, albeit a system that is operated solely by engine oil pressure. This reference teaches that it is desirable to lock the otherwise variable components of the system in fixed positions relative to one another during low speed operation conditions, but only teaches a system in which a single set of fixed positions can be achieved.

The invention of the aforesaid U.S. Pat. No. 6,250,265 is a hydraulic variable camshaft timing system with a locking plate that is spring biased against engine oil pressure from a position out of locking engagement with a variable position camshaft phaser housing when engine oil pressure is high, and into a locking position with the phaser housing when engine oil pressure is low. The locking plate of this invention has a multitude of teeth in an annular array, and the teeth of the locking plate engage the teeth of the phaser housing when the locking plate is in locking engagement with the phaser housing. Because the locking plate and the phaser housing each have a multitude of engageable teeth, the locking plate can lockingly engage the phaser housing at a multitude of relative circumferential positions between the locking plate and the phaser housing. The ability of the invention of U.S. Pat. No. 6,250,265 to lock the phaser housing in any of a multitude of relative positions beneficially reduces phaser oil consumption and phaser oscillation or dither, and it reduces the control system operating requirements from fulltime, in a system where there is no locking capability, to part-time.

It is known in the art that any camshaft phaser locking arrangement must be torsionally rigid, but axially flexible, to reliably engage and disengage when required. It must also be able to operate with minimal backlash between the locking plate and the phaser housing.

SUMMARY OF THE INVENTION

A variable camshaft timing system according to the present invention is, like the system of the aforesaid U.S. Pat. No. 6,250,265, a camshaft torque pulse actuated, engine oil powered hydraulic system that is used to change the position of a lobed vane-type rotor within lobe receiving recesses of a surrounding housing. Further, the variable camshaft timing system of the present invention, like that of the aforesaid U.S. Pat. No. 6,250,265, has a locking plate that is spring biased against the effects of engine oil pressure, to prevent relative motion between the rotor and the housing, except when the engine oil pressure exceeds a predetermined value, and locking according to the present invention, like that of the aforesaid U.S. Pat. No. 6,250,265, can occur at one or another of a multitude of positions of the rotor and the housing relative to one another. It is also contemplated that the invention of the present application can be adapted to an hybrid variable camshaft timing system operated both on engine oil pressure and oil pressure resulting from camshaft torque pulses, such as that of U.S. Pat. No. 5,657,725 (Butterfield et al.), which is also assigned to the assignee of this application, the disclosure of which is also incorporated by reference herein, and to an engine oil pressure activated system such as that of the aforesaid U.S. Pat. No. 2,861,557.

Unlike the invention of the aforesaid U.S. Pat. No. 6,250,265 however, the locking plate of the present invention is physically connected to the lobed rotor of the variable camshaft timing phaser, and this connection is by way of a plurality of straps, preferably three straps, which are arranged in an annular array, opposed ends of each of which are secured, for example, by riveting or bolting, to the locking plate and the lobed rotor, respectively. The straps are oriented so that, in their non-locking positions of the locking plate and the rotor of the phaser, they serve to bias the locking plate toward the rotor against the effects of engine oil pressure acting on the locking plate. Thus, when the engine oil pressure falls below an acceptable minimum, an on/off solenoid, which controls the oil pressure, turns off, and the straps bias the locking plate into locking position with the rotor of the phaser.

The strap connection between the locking plate and the rotor of the phaser is axially flexible, in that it permits rapid engagement and disengagement between such elements and it is also circumferentially rigid, to thereby prevent relative circumferential motion therebetween. Further, the strap connection between the locking plate and the phaser rotor makes it possible to eliminate or to substantially eliminate backlash between the locking plate and the rotor, compared to that achieved by the invention of U.S. Pat. No. 6,250,265, by providing wedge-shaped interengaging teeth on the locking plate and the rotor. This form of engagement is a very low backlash form of engagement in comparison to engagement by interengaging spline teeth.

Accordingly, it is an object of the present invention to provide an improved vane-type, torque pulse actuated, hydraulic variable valve timing, or variable camshaft timing system for an internal combustion engine. More particularly, it is an object of the present invention to provide a variable valve timing or variable camshaft timing system of the foregoing character, with an improved arrangement for locking a position of a lobed rotor relative to the position of the housing, in which the rotor is normally free to oscillate whenever engine operating conditions make it desirable to prevent relative motion between the rotor and the housing. Even more particularly, it is an object of the present invention to provide a variable valve timing or a variable camshaft timing system of the foregoing character that eliminates or virtually eliminates backlash between a locking plate of the system and the rotor thereof.

For a further understanding of the present invention and the objects thereof, attention is directed to the drawings and the following brief description thereof, to the detailed description of the preferred embodiment and to the appended claims.

DETAILED DESCRIPTION OF THE INVENTION

Figure 1A:
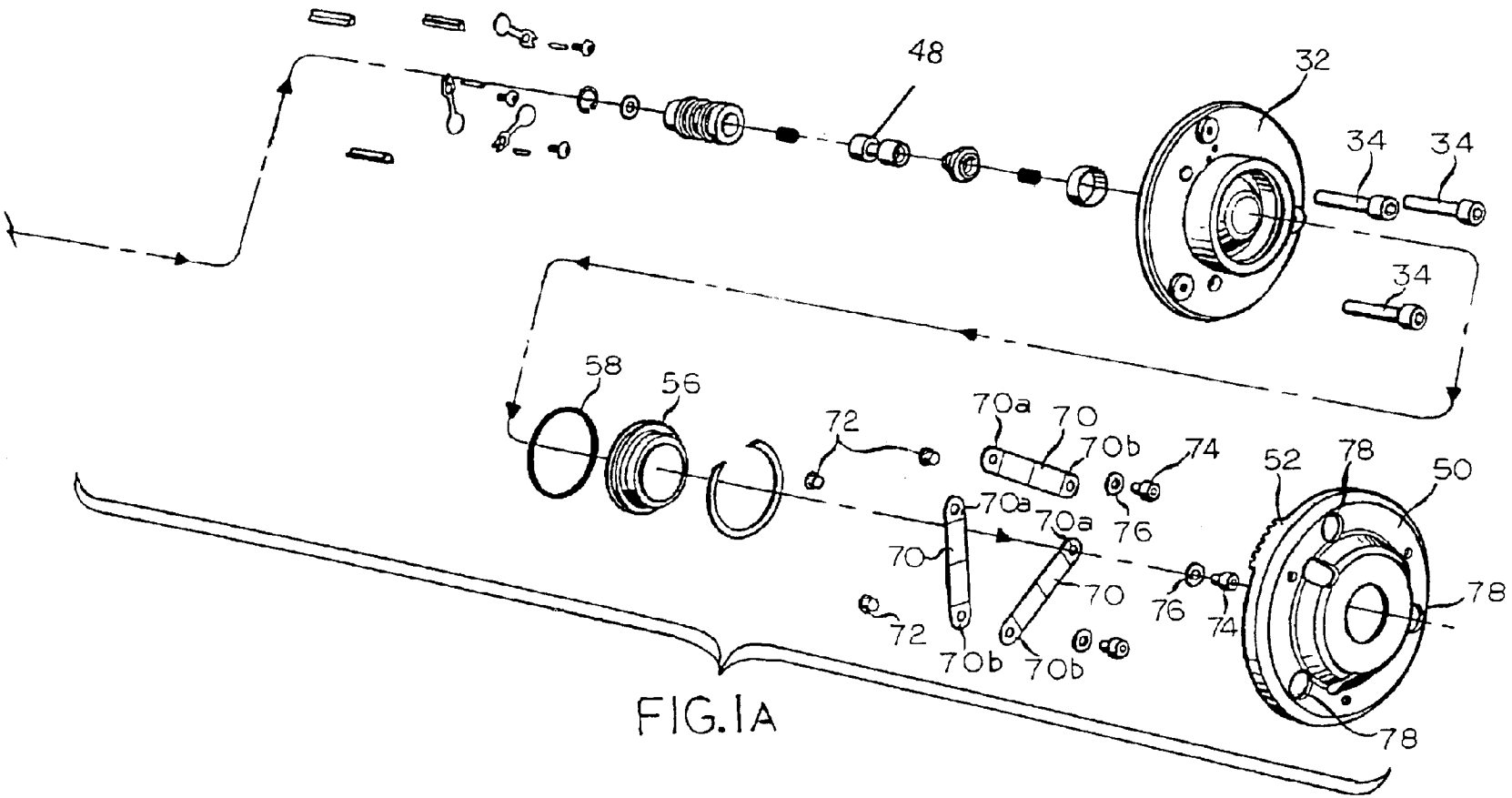
FIGS. 1A and 1B show an exploded perspective view of the elements of a variable camshaft timing system according to the preferred embodiment of the present invention.
Figure 1B:
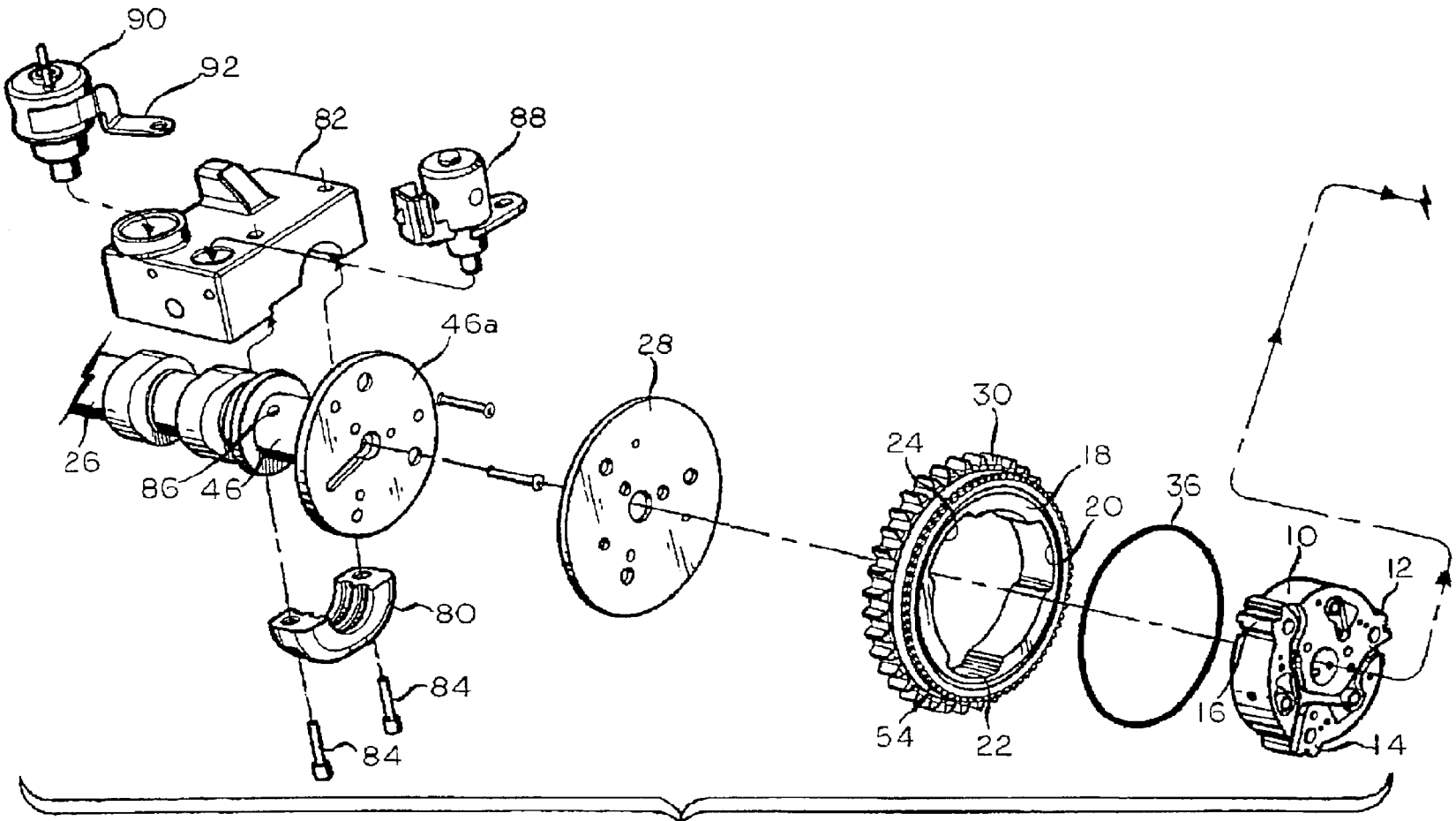
Figure 2:
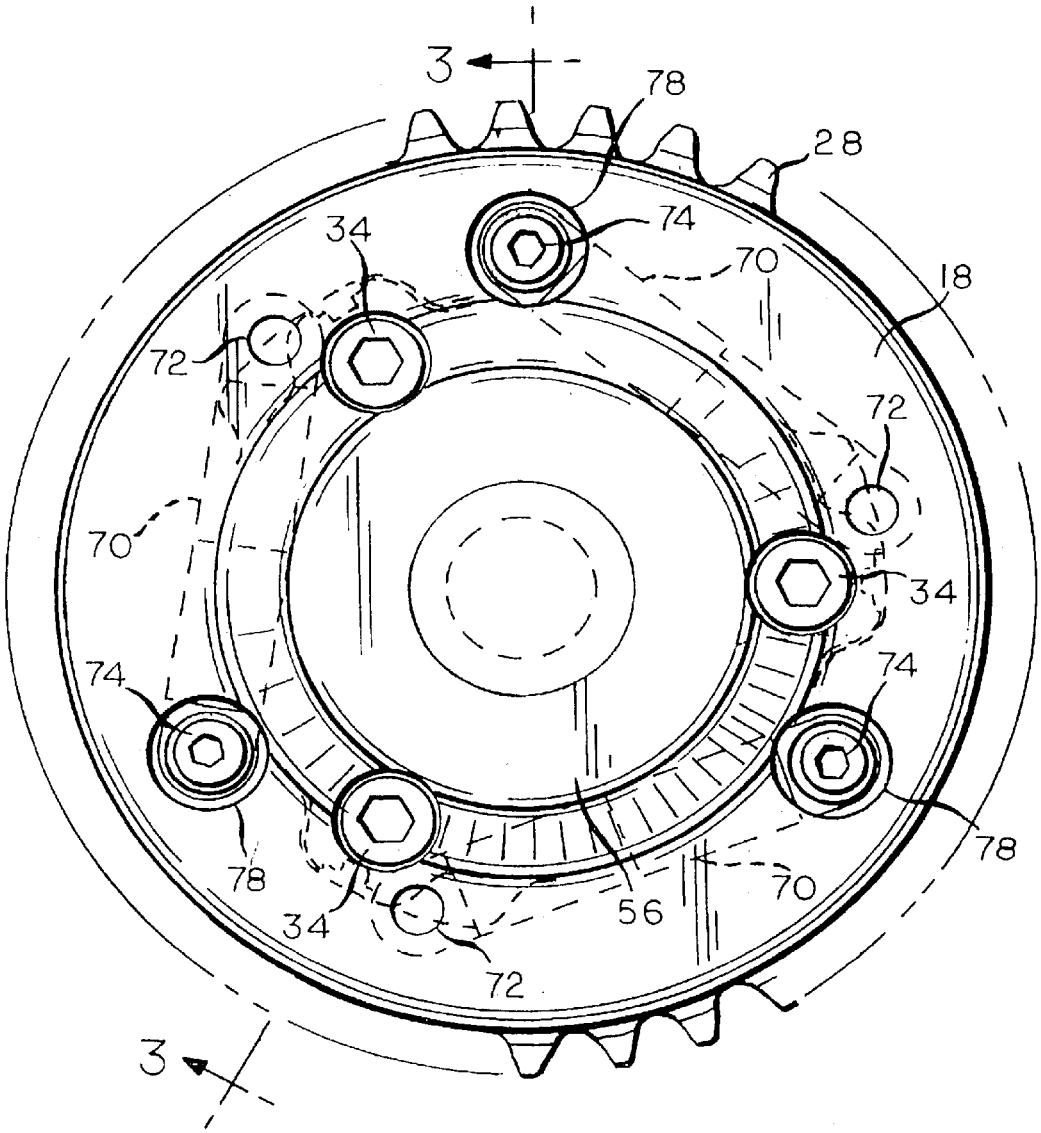
FIG. 2 shows an end elevational view of a variable camshaft timing system according to FIGS. 1A and 1B.
Figure 3:
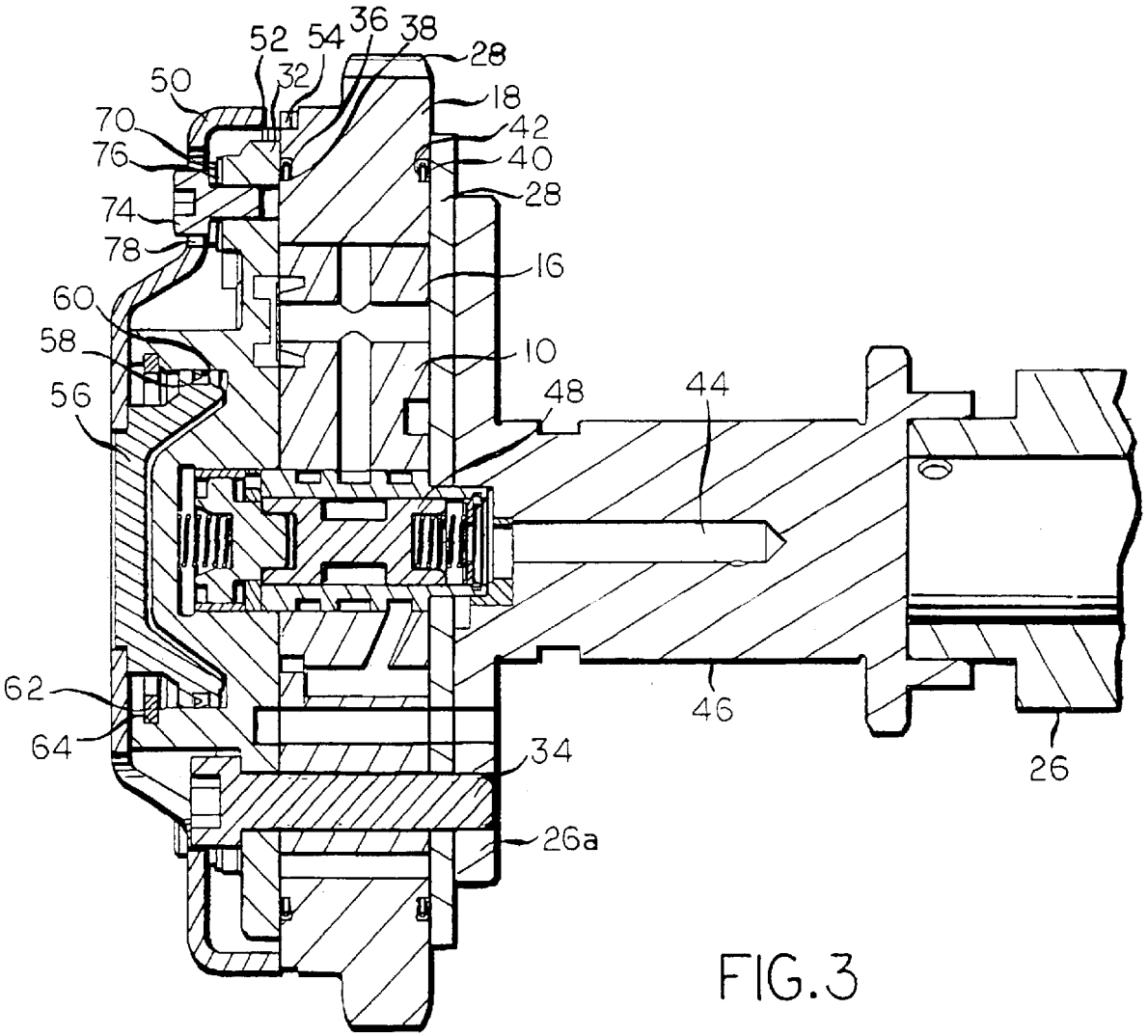
FIG. 3 shows a sectional view taken along line 3—3 of FIG. 2.

A variable camshaft timing system according to the present invention is provided with a vane-type rotor 10, the rotor 10 being provided with a plurality of radially outwardly projecting lobes, shown as three (3) such lobes 12, 14, 16. An annular sprocket-type housing 18 surrounds the rotor 10, and the housing 18 has recesses 20, 22, 24, which receive the lobes 12, 14, 16, respectively. The rotor 10 is bolted to a flange 46*a* at an end of an extension 46 to a rotating camshaft 26 with an inner plate 28 positioned therebetween, so that the rotor 10 is rotatable with the camshaft 26, but is not oscillatable with respect thereto. The housing 18 is provided with sprocket teeth 30 on an exterior thereof. The assembly that includes the camshaft 26, with the rotor 10 and the housing 18, is caused to rotate by torque applied to the housing 18 by an endless chain (not shown) that engages the sprocket teeth 30, and motion is imparted to the endless chain by a rotating crankshaft (not shown) or another rotating camshaft (also not shown). However, the housing 18, which rotates with the camshaft 26, as explained, is oscillatable with respect to the camshaft 26 to change the phase of the camshaft 26 relative to the crankshaft or to another camshaft. In that regard, the circumferential extent of each of the recesses 20, 22, 24 is greater than the circumferential extent of each of the lobes 12, 14, 16 that is received therein to permit limited relative circumferential motion between the housing 18 and the rotor 10. To enclose the recesses 20, 22, 24 of the housing 18, a cover plate 32 is bolted to the rotor 10 by a plurality of circumferentially spaced apart bolts 34, and an annular seal 36, which is positioned in a recess 38 on an outer face of the housing 18 to sealingly engage a face of the cover plate 32.

Makeup engine oil from an engine main oil gallery (not shown) flows into the recesses 20, 22, 24 by way of a passage 44 in the camshaft bearing extension 46, the oil being selectively distributed to one side or the other of the lobes 12, 14, 16 in the recesses 20, 22, 24 by a sliding action of a spool valve 48 that is positioned within the rotor 10 and cover plate 32 coaxially of the camshaft 26 and the camshaft extension 46, as is explained in the aforesaid U.S. Pat. No. 5,107,804.

An annular locking plate 50 is positioned concentrically with respect to the rotor 10 and the cover plate 32, and is axially slidable with respect to the rotor 10 and the cover plate 32. The locking plate 50 is provided with a plurality of teeth 52 in an annular array, and the teeth 52 are positioned to engage a plurality of teeth 54 on the housing 18 when the locking plate 50 is at an axially innermost position relative to the housing 18, which prevents relative oscillating motion between the housing 18 and the rotor 10. However, at an axially outermost position of the locking plate 50, the teeth 52 are out of engagement with the teeth 54, to permit relative oscillating motion between the housing 18 and the rotor 10. The locking plate 50 is urged to such an axially outer most position by the pressure of the engine oil from an independent passage 96, located in the camshaft bearing extension 46. The oil present in the passage 96 is controlled by an on/off solenoid 90. Depending on the state of the on/off solenoid, the locking plate is urged to an axially outermost position on a locking piston 56, which is sealingly positioned relative to the locking plate 50 within an annulus of the locking plate 50 to axially reciprocate with the locking plate 50. An annular seal 58 is positioned in a recess 60 on an outside diameter of the locking piston 56 to permit relative axial motion between the locking piston 56 and an inside diameter of the cover plate 32, and a C-shaped retaining ring 62 is positioned in a recess 64 of an inside diameter of the cover plate 32 to prevent excessive outward motion of the locking piston 56 relative to the cover plate 32.

The locking plate 50 is spring biased to its axially innermost position by a plurality of metallic straps 70, shown as three (3) such straps. In that regard, each of the straps 70 is flat in its rest or unloaded position, and is distorted in a nearly Z-shaped configuration in the unlocking position of the locking plate 50. An end 70*a* of each of the straps 70 is secured to the locking plate 50 by a rivet 72, and an opposed end 70*b* of each of the straps 70 is secured to the cover plate 32 by a threaded fastener 74 with a washer 76 being provided therefor. The locking plate 50 is provided with a plurality of apertures 78 that are axially aligned with a threaded fastener 74, but somewhat larger than the threaded fastener 74, to permit relative axial motion between the locking plate 50 and the cover plate 32. The use of a riveted connection between the end 70*b* of each of the straps 70 and the cover plate 32 is also contemplated.

The engagement between the teeth 52 on the locking plate 50 and the teeth 54 on the housing 18 can be essentially free of backlash if a wedge shape is provided for each of such teeth, whereas an engagement between interengaging splined teeth between elements that move axially relative to each other must inherently have some backlash between such elements. In that regard, it has been found that an angle of five degrees on each of the wedge-shaped teeth 52, 54 provides for good torque transmission with a minimum amount of engagement and virtually no backlash. A tapered tooth angle on wedge-shaped teeth provides increased torque transmission, but involves some minimal backlash to avoid wedging of the locking plate 50 into the annular housing 18. Further, the use of a large number of teeth 52 to engage a like number of teeth 54 avoids the need to ensure that the locking plate 50 and the annular housing 18 are closely circumferentially aligned before the locking plate 50 can engage the annular housing 18. To minimize loads on the teeth 52, 54 when they are engaged, it is preferable that they be positioned on large, external diameters. This will also allow the use of finer pitch teeth and more locking positions.

The camshaft bearing extension 46 is rotatably supported in a split bearing that is made up of a lower half 80 and an upper half 82, which are removably joined to each other by threaded fasteners 84. The bearing formed by the bearing halves 80, 82 also functions as a valve to introduce engine oil through a radial passage 86 in the camshaft extension bearing 46. Three independent passages, including the radial passage 86 are present in the camshaft extension bearing 46 and allow the flow of engine oil into the VCT system. The first independent passage 44 is the passage for engine oil supplied to fill the phaser and to make up the oil that is lost through leakage. The second passage 86 is controlled via a pulse-width modulated (PWM) solenoid 88. The PWM solenoid 88 modulates the pressure that moves the spool valve 48, which controls the direction of the VCT actuation and the rate of change of the actuation. The third independent passage 96 communicates with the locking plate and is controlled by the on/off solenoid 90. The on/off solenoid 90 controls when the locking plate 50 engages and disengages the rotor 10. The on/off solenoid 90 is secured to the upper half 82 of the bearing by a mounting bracket 92.

The variable camshaft timing system of the present invention, as heretofore described, can be controlled in its operation either by an open loop control system or a closed loop control system, both of which are described in the aforesaid Ser. No. 09/450,456. Further, because the locking plate 50 of the VCT system of the present invention is external to the other elements of the system, it is adaptable to other types of VCT systems, such as engine oil pressure actuated systems, for example, of the type described in co-pending U.S. patent application Ser. No. 09/473,804, which is assigned to the assignee of the present application, the disclosure of which is also incorporated by reference herein, and hybrid systems, such as those described in the aforesaid U.S. Pat. No. 5,657,725.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable camshaft timing device for an internal combustion engine having at least one camshaft comprising:

a vane-type rotor having at least one lobe secured to the camshaft for rotation therewith, the rotor being non-oscillatable with respect to the camshaft;

an annular housing surrounding the rotor and having a first annular array of teeth and at least one recess having a circumferential extent greater than the circumferential extent of the at least one lobe and receiving the at least one lobe, the annular housing being rotatable with the camshaft and the rotor, and being oscillatable with respect to the camshaft and the rotor;

a locking means reactive to engine oil pressure for preventing relative circumferential motion between the housing and the rotor at one of a plurality of relative circumferential position of the housing and the rotor during periods of low engine oil pressure, the locking means comprising an annular locking plate having a second annular array of teeth in engagement with the first annular array of teeth in a first position of the annular locking plate to prevent relative motion between the housing and the rotor and being out of engagement with the first annular array of teeth in a second position of the annular locking plate to permit relative circumferential motion between the annular housing and the rotor, and at least one metallic strap having an end secured to the annular locking plate and an opposed end secured to the rotor for urging the locking means to the first position in locking engagement with the rotor during periods of low engine oil pressure.

2. The variable camshaft timing system of claim 1, wherein the annular locking plate is positioned relative to a longitudinal central axis of the camshaft and is moveable along the longitudinal central axis of the camshaft between the first position and the second position.

3. The variable camshaft timing system of claim 2, wherein the at least one metallic strap comprises at least three circumferentially spaced apart metallic straps, each of the metallic straps having an end secured to the locking plate and an opposed end secured to the rotor.

4. The variable camshaft timing system of claim 1, wherein the rotor comprises at least three circumferentially spaced apart vanes, and wherein the annular housing comprises a like number of circumferentially spaced apart recesses.

* * * * *